US007757762B2

(12) United States Patent
O'Malley

(10) Patent No.: US 7,757,762 B2
(45) Date of Patent: Jul. 20, 2010

(54) DOWNHOLE TOOLS HAVING SCREENS FOR INSERTION INTO GRAVEL DISPOSED IN WELLBORES AND METHODS OF INSTALLING SAME

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 129 days.

(21) Appl. No.: 11/906,420

(22) Filed: Oct. 2, 2007

(65) Prior Publication Data

US 2009/0084549 A1 Apr. 2, 2009

(51) Int. Cl.
*E21B 43/04* (2006.01)
*E21B 43/00* (2006.01)

(52) U.S. Cl. ..... 166/278; 166/51; 166/227; 166/372

(58) Field of Classification Search ..... 166/278, 166/51, 372, 227, 68
See application file for complete search history.

(56) References Cited

U.S. PATENT DOCUMENTS

| | | | | |
|---|---|---|---|---|
| 4,653,586 | A * | 3/1987 | Skinner | 166/278 |
| 5,036,920 | A | 8/1991 | Cornette et al. | |
| 5,327,960 | A | 7/1994 | Cornette et al. | |
| 5,348,092 | A | 9/1994 | Cornette et al. | |
| 5,366,009 | A | 11/1994 | Cornette et al. | |
| 5,394,938 | A | 3/1995 | Cornette et al. | |
| 5,411,090 | A | 5/1995 | Cornette et al. | |
| 6,923,262 | B2 | 8/2005 | Broome et al. | |
| 2004/0211560 | A1 * | 10/2004 | Richard et al. | 166/278 |
| 2006/0196674 | A1 * | 9/2006 | Butler et al. | 166/372 |

OTHER PUBLICATIONS

Oilwell Hydraulic Pumping Systems—Mobile Test Unit, 2001, pp. 1-18, Oilwell Hydraulics, Inc., Odessa, Texas.
Henry Restarick, Horizontal Completion Options in Reservoirs With Sand Problems, Mar. 11, 1995, pp. 545-560, SPE 29831, Society of Petroleum Engineers, Inc., U.S.A.
E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.
E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.
Stephen P. Mathis, Sand Management: A Review of Approaches and Concerns, May 13, 2003, pp. 1-7, SPE 82240, Society of Petroleum Engineers Inc., U.S.A.

* cited by examiner

*Primary Examiner*—David J Bagnell
*Assistant Examiner*—Yong-Suk Ro
(74) *Attorney, Agent, or Firm*—Greenberg Traurig LLP; Anthony F. Matheny

(57) ABSTRACT

Downhole tools for gravel pack completion processes in wellbores comprise a screen, an isolation device comprising a sealing element disposed above the screen, and an artificial lifting device disposed above the isolation device. Upon actuation, the sealing element divides the wellbore into an upper zone and a lower zone so that the screen is disposed in the lower zone and the artificial lifting device is disposed in the upper zone. The two zones are in fluid communication with each other through a longitudinal bore within the downhole tool. In operation, the artificial lifting device of the downhole tool creates a negative pressure so wellbore fluid is transported from the lower zone into the upper zone. Due to this flow of fluid through the downhole tool, gravel disposed within the wellbore becomes sufficiently fluidized to facilitate the screen being inserted into the gravel form the gravel pack completion.

20 Claims, 3 Drawing Sheets

DOWNHOLE TOOLS HAVING SCREENS FOR INSERTION INTO GRAVEL DISPOSED IN WELLBORES AND METHODS OF INSTALLING SAME

BACKGROUND

1. Field of Invention

The invention is directed to gravel packs in oil and gas wells and, in particular, to downhole tools comprising screens for insertion into the gravel pack completions in wellbores.

2. Description of Art

In completing wells having production or injection zones which lie adjacent to incompetent formations formed from unconsolidated matrixes such as loose sandstone, or which lie adjacent formations that have been hydraulically-fractured and propped such as through fracturing processes, sand control problems often arise during the operational life of the well. These sand control problems are encountered when large volumes of sand and/or other particulate material such as backflow of proppants from a hydraulically-fractured formation dislodge from the formation and become entrained in the formation fluids and are produced therewith into the wellbore. These produced materials have an adverse effect on the operation of the well because they can cause erosion and plugging of the well equipment which, in turn, leads to high maintenance costs and considerable downtime of the well.

One technique for controlling sand production in a wellbore is referred to as "gravel packing" or forming a "gravel pack completion." In general, a gravel pack completion comprises a screen, such as a fluid-permeable liner, a perforated liner, a slotted liner, a pre-packed screen, that is disposed within an open-hole or cased wellbore adjacent the incompetent or fractured zone and is surrounded by aggregate or particulate material collectively referred to as "gravel." As known in the art, the gravel particles are sized to block or filter out the formation particulates that may become entrained in the produced fluids, while the openings in the screen are sized to block the gravel from flowing into the screen.

One method for installing a typical gravel pack completion in a wellbore involves placing the gravel in the wellbore first and then driving, rotating, or washing the screen into the gravel to form the gravel pack. To assist in installing the screen in gravel disposed in a wellbore, the liner may include one or more auger blades, referred to herein as an "auger-flighted screen."

SUMMARY OF INVENTION

In accordance with the disclosure herein, a screen is included as part of a downhole tool designed to assist in the installation of the screen into gravel disposed in a wellbore. Broadly, the downhole tool includes the liner or screen having at least one port disposed in the screen's outer wall surface, a dynamic isolation device comprising a sealing element, and an artificial lifting device. The artificial lifting device is disposed above the dynamic isolation device which, in turn, is disposed above the screen so that the sealing element can divide the wellbore into two zones, an upper zone and a lower zone. The screen will, therefore, be disposed in the lower zone and the artificial lifting device will be disposed in the upper zone. The two zones are in fluid communication with each other through a longitudinal bore within the downhole tool.

In operation, the artificial lifting device of the downhole tool creates a negative pressure such that wellbore fluid is transported from the lower zone, through the downhole tool and into the upper zone. Due to this flow of fluid through the downhole tool, gravel disposed within the wellbore becomes sufficiently fluidized due to an increase in pressure within the lower zone. This fluidization of the gravel facilitates the screen to be inserted into the gravel form the gravel pack completion.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
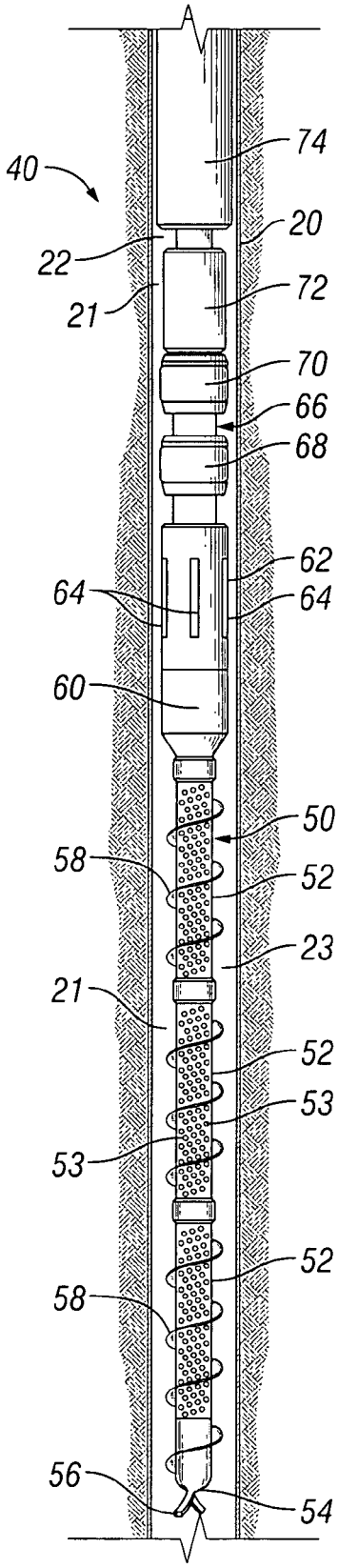
FIG. 1 is a perspective view of one specific embodiment of a downhole tool having an auger-flighted screen disclosed herein shown in the run-in position.
Figure 2:
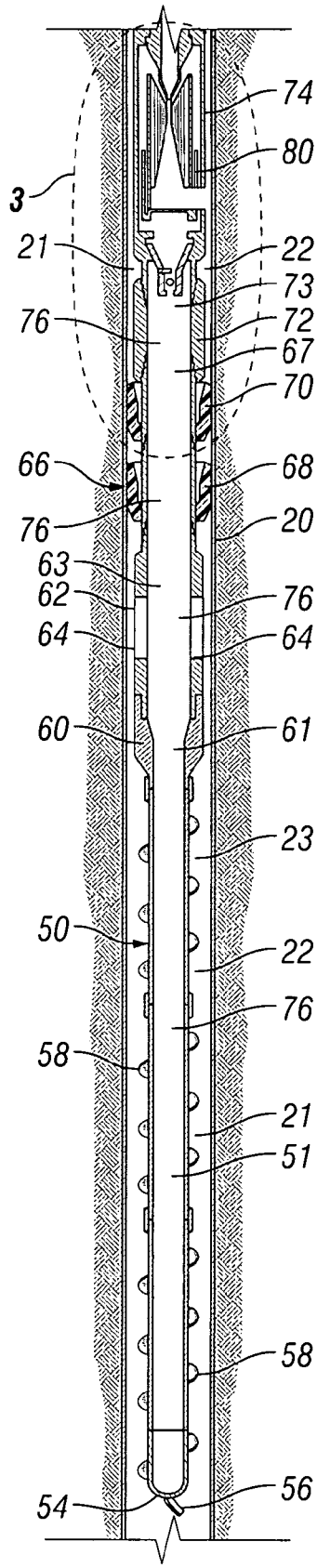
FIG. 2 is cross-sectional view of the downhole tool of FIG. 1 shown in the set position.
Figure 3:
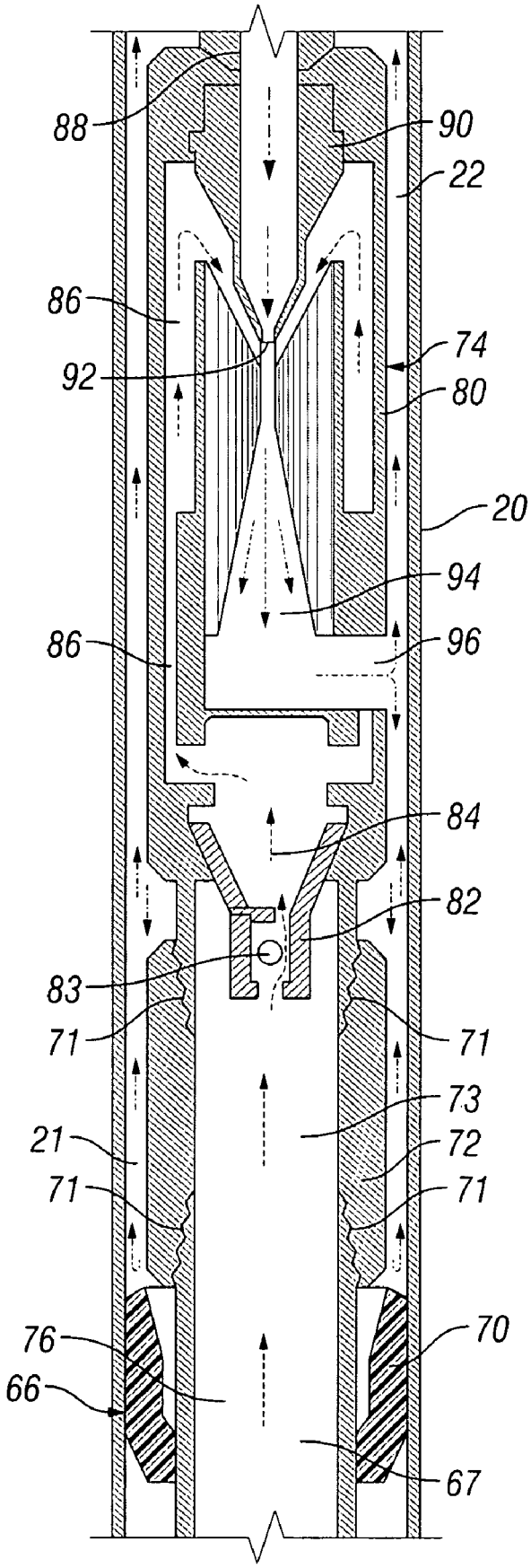
FIG. 3 is a detailed cross-sectional view of the artificial lift device of the downhole tool of FIGS. 1 and 2.

Referring now to FIGS. 1-3, one embodiment of downhole tool 40 is shown disposed in wellbore 20 within an earthen formation. Wellbore 20 comprises casing 30. This embodiment of downhole tool 40 comprises screen 50 having bore 51, and one or more sections 52 having ports 53 in fluid communication with bore 51 and the outer wall surface of screen 50 so that bore 51 can be placed in fluid communication with annulus 21 of wellbore 20. As shown in FIGS. 1-2, screen 50 has three sections 52 connected in series through any known device or method, for example, threads (not shown). Closed end 54 of screen 50 includes bit 56 to facilitate insertion of screen 50 into the gravel (not shown) disposed within wellbore 20. Auger 58 is spiraled or "flighted" around the outer wall surface of screen 50 to further facilitate insertion of screen 50 into the gravel. Thus, screen 50 in this embodiment is referred to as an auger-flighted screen.

In the embodiment of FIGS. 1-3, screen 50 is releasably secured to lower coupler 60 through any known device or method, for example, threads (not shown). Lower coupler 60 comprises bore 61 and is releasably secured to ported member or pup 62 through any known device or method, for example, threads (not shown). Ported member 62 includes bore 63 and one or more ports 64 in fluid communication with bore 63 and an outer wall surface of ported member 62 so that bore 63 can be placed in fluid communication with annulus 21 of wellbore 20.

Ported member 62 is releasably secured to isolation device 66 through any known device or method, for example, threads (not shown). Isolation device 66 comprises bore 67. Isolation device 66 contacts the inner wall surface of wellbore 20 when isolation device 66 is placed in the set position (FIG. 2).

In the set position, isolation device 66, separates annulus 21 of wellbore 20 into two zones, upper zone 22 disposed above isolation device 66 and lower zone 23 disposed above isolation device 66. Isolation device 66 comprises a dynamic seal against the inner wall surface of wellbore 20 such that isolation device 66 is in sliding engagement with the inner wall surface of wellbore 20. Accordingly, downhole tool 40 is capable of sliding downward along the inner wall surface of wellbore 20 during insertion or installation of screen 50 into the gravel disposed within wellbore 20. Isolation device 66 is shown in the embodiment of FIGS. 1-3 as comprising two swab packer cups 68, 70. Such isolation devices 66 are known in the art.

Isolation device 66 is not required to form a leak-proof seal with the inner wall surface of wellbore 20. Fluid is permitted to flow between isolation device 66 and the inner wall surface of wellbore 20, provided that the connection between isolation device 66 and the inner wall surface of wellbore 20 is sufficient to allow wellbore fluid to be transported from the lower zone to the upper zone as discussed in greater detail below.

Isolation device 66 is releasably secured to upper coupler 72 through any known device or method, for example, threads 71 (shown in FIG. 3). Upper coupler 72 comprises bore 73 and is releasably secured to artificial lift device 74 through threads 71 (FIG. 3) or any other known device or method. As discussed in greater detail below, artificial lift device 74 functions by lifting, transporting, of flowing fluid from lower zone 23 of annulus 21 of wellbore 20 when isolation device 66 and, thus, downhole tool 40 is in the set position within wellbore 20. Therefore, fluid from lower zone 23 of annulus 21 of wellbore 20 can be lifted, transported, or flowed above isolation device 66 into upper zone 22 of annulus 21 of wellbore 20 so that the fluid can be lifted, transported, or flowed up and out of wellbore 20.

Artificial lift device 74 may be any device known to persons of ordinary skill in the art. In the embodiment shown in FIGS. 1-3, artificial lift device 74 comprises jet pump 80. Suitable jet pumps 80 are available from Oilwell Hydraulics, Inc. of Odessa, Tex.

In the embodiment shown in FIGS. 1-3, jet pump 80 includes valve 82, shown as a one-way check valve having ball 83, cavity 84, flow path 86, fluid injector tubing 88, fluid accelerator 90 with fluid exhaust port 92, chamber 94, and outlet 96. As shown in FIG. 3, chamber 94 has a conical-shape to facilitate movement of fluid out from fluid exhaust port 92 and through outlet 96.

Once assembled, longitudinal bore 76 is formed between screen 50, lower coupler 60, ported member 62, isolation device 66, and upper coupler 72 by placing bores 51, 61, 63, 67, 73 in fluid communication with each other. Longitudinal bore 76 is in fluid communication with outlet 96 of jet pump 80 through valve 82, cavity 84, flow path 86, fluid exhaust port 92, and chamber 94.

In one particular operation of downhole tool 40, a tubing string (not shown) is used to dispose downhole tool 40 into wellbore 20. After disposition within wellbore 20, isolation device 66 is activated so that annulus 21 of wellbore 20 is divided into upper zone 22 above isolation device 66 and lower zone 23 below isolation device 66. Activation of isolation device 66 can be accomplished using known methods.

With particular reference to the arrows shown in FIG. 3 that illustrate fluid flow through downhole tool 40, after setting isolation device 66 within wellbore 20, fluid, such as water, is pumped down fluid injector tubing 88 through fluid accelerator 90, and out of fluid exhaust port 92 into chamber 94. Fluid accelerator 90 and fluid exhaust port 92 increase the pressure at which the fluid is expelled from fluid injector tubing 88 thereby creating a venturi effect. Due to the increased pressure expulsion of fluid through fluid exhaust port 92, negative pressure is created within jet pump 80 and, thus, in upper zone 22 so that wellbore fluid located within lower zone 23 of annulus 21 below isolation device 66 is lifted, transported, or flowed through ports 64 of ported member 62 and through ports 53 in screen 50, into longitudinal bore 76. The wellbore fluid continues to be lifted, transported, or flowed up through longitudinal bore 76 and into jet pump 68 through valve 82. The wellbore fluid is then lifted, transported, or flowed through flow path 86 until it mixes with the fluid being pumped down fluid injector tubing 88, through fluid accelerator 90, and out of fluid exhaust port 92 into chamber 94. This mixture of wellbore fluid with the fluid being pumped down fluid injector tubing 88 then exits jet pump 80 through outlet 96 into upper zone 22 of annulus 21 of wellbore 20 so that it can travel within wellbore 20 up toward the surface of wellbore 20.

As a result of the activation of jet pump 80, the wellbore fluid is lifted, transported, or flowed from lower zone 23 of annulus 21 to pull hydrostatic pressure off of the upper surface of the gravel (not shown) which lessens the overburden pressure acting downward on the top of the gravel. Therefore, the gravel is fluidized sufficiently to facilitate installation of screen 50 into the gravel. In other words, as a result of fluidization of the gravel due to wellbore fluid being lifted, transported, or flowed from lower zone 23 into upper zone 22, downhole tool 40 and/or screen 50 can be moved downward more easily so that screen 50 is inserted or installed into the gravel. In one particular embodiment, screen 50 is rotated to facilitate installation of screen 50 into gravel. In another embodiment, downhole tool 40 and, thus, screen 50, is rotated to facilitate installation of screen 50 into gravel.

As mentioned above, the methods of installing the liner or screen into the gravel temporarily relieve an overbalance or overburden pressure acting on the top of the gravel relative to the earthen formation. This overburden pressure is relieved by decreasing the pressure above isolation device 66 and increasing the pressure below isolation device 66 so that the gravel becomes fluidized as a result of wellbore fluid being lifted, transported, or flowed from and through lower zone 23 and into upper zone 22. This fluidization of the gravel facilitates insertion of screen 50 into the gravel.

Figure 4:
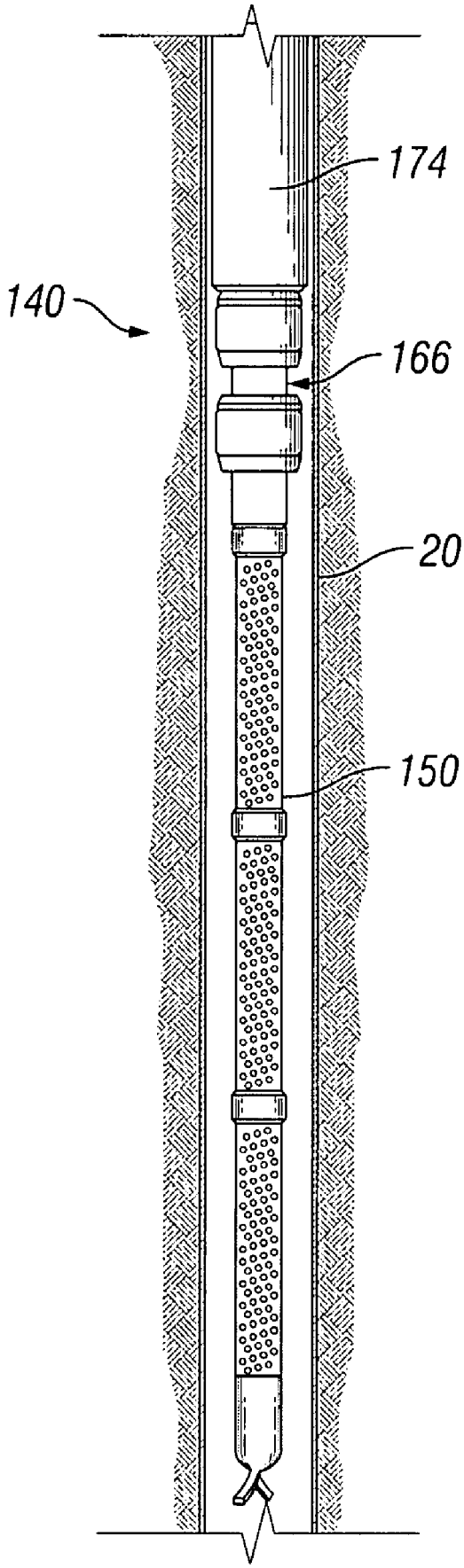
FIG. 4 is a perspective view of another embodiment of the downhole tool having a screen disclosed herein shown in the run-in position.

Referring now to FIG. 4, in another embodiment, downhole tool 140 includes screen 150, isolation device 166, and artificial lifting device 174. Each of these three components is releasably connected directly to each other so that screen 150 is disposed below isolation device 166 and isolation device 166 is disposed below artificial lifting device 174. With the exception of screen 50 comprising auger 58 in the embodiment shown in FIGS. 1-3, each of screen 150, isolation device 166, and artificial lifting device 174 in the embodiment shown in FIG. 4 is identical to screen 50, isolation device 66, and artificial lifting device 74 in downhole tool 40 (FIGS. 1-3). Additionally, downhole tool 140 operates in the same manner as described above with respect to downhole tool 40 (FIGS. 1-3).

It is to be understood that the invention is not limited to the exact details of construction, operation, exact materials, or embodiments shown and described, as modifications and equivalents will be apparent to one skilled in the art. For example, the screen is not required to include an auger. Additionally, the artificial lift device is not required to be a jet pump. Further, the jet pump is not required to include a valve or any of the other the specific components described with respect to the jet pump shown in FIGS. 2-3. Moreover, the isolation device can be any type of isolation device known in the art used to divide a wellbore and be in sliding engagement with the inner wall surface of the wellbore. Additionally, the upper and lower couplers are not required. Further, the inner wall surface of the wellbore may be disposed along the open hole formation, along wellbore casing (as shown in FIGS. 1-2 and 4), or along a tubular member, including a packer or bridge plug, disposed within the wellbore casing or open hole formation. Accordingly, the invention is therefore to be limited only by the scope of the appended claims.

What is claimed is:

1. A downhole tool for inserting a screen into gravel disposed within a wellbore, the downhole tool comprising:

a screen comprising a screen bore, an outer wall surface, a closed lower end, and a plurality of holes in fluid communication with the screen bore and the outer wall surface;

an isolation device disposed above the screen, the isolation device having a sealing element for engagement with an inner wall surface of a wellbore to divide an annulus of the wellbore, and an isolation device bore in fluid communication with the screen bore; and an artificial lifting device disposed above the isolation device, the artificial lifting device having an outlet in fluid communication with the annulus of the wellbore above the isolation device, the outlet being in fluid communication with the isolation device bore, wherein the artificial lift device provides wellbore fluid disposed within the wellbore below the sealing element to be lifted from the wellbore, through at least one of the plurality of holes in the screen, through the screen bore, through the isolation device bore, into the artificial lifting device, out of the artificial lifting device through the outlet of the artificial lifting device, and into the annulus of the wellbore above the sealing element causing insertion of the screen into gravel disposed within a wellbore.

2. The downhole tool of claim 1, further comprising a ported member disposed above the screen and below the isolation device, the ported member having a ported member bore in fluid communication with the screen bore, the sealing element bore, and at least one port in fluid communication with the ported member bore and a ported member outer wall surface.

3. The downhole tool of claim 2, wherein the screen is releasably connected to the ported member, the ported member is releasably connected to the isolation device, and the isolation device is releasably connected to the artificial lifting device.

4. The downhole tool of claim 2, wherein the screen and the ported member are releasably connected to each other by a lower coupler and the isolation device and artificial lifting device are releasably connected to each other by an upper coupler.

5. The downhole tool of claim 1, wherein the artificial lifting device is a jet pump.

6. The downhole tool of claim 1, wherein the screen is releasably connected to the isolation device and the isolation device is releasably connected to the artificial lifting device.

7. The downhole tool of claim 1, wherein the screen and the isolation device are releasably connected to each other by a lower coupler.

8. The downhole tool of claim 7, wherein the isolation device and artificial lifting device are releasably connected to each other by an upper coupler.

9. A method of installing a screen in gravel disposed in a wellbore, the method comprising the steps of:

(a) running a downhole tool in a wellbore, the downhole tool comprising a screen, a dynamic isolation device, and an artificial lifting device, the screen being disposed below the dynamic isolation device and the dynamic isolation device being disposed below the artificial lifting device;

(b) contacting the downhole tool with gravel disposed within the wellbore;

(c) contacting the dynamic isolation device with an inner wall surface of the wellbore thereby dividing the wellbore into an upper zone and a lower zone, the upper zone being disposed above the dynamic isolation device and the lower zone being disposed below the dynamic isolation device;

(d) transporting a wellbore fluid from the lower zone and into the upper zone through a bore within the downhole tool; and (e) inserting the screen into the gravel.

10. The method of claim 9, wherein step (d) comprises pumping fluid down a tubing string in fluid communication with the artificial lifting device.

11. The method of claim 9, wherein step (d) is performed simultaneously with step (e).

12. The method of claim 9, wherein the screen comprises an auger disposed on an outer wall surface of the screen and step (e) comprises rotating the screen and sliding the dynamic isolation device downward along the inner wall surface of the wellbore.

13. The method of claim 9, wherein step (d) comprises flowing fluid from the lower zone of the wellbore, through at least one port in the screen into a screen bore, through a dynamic isolation device bore, into the artificial lifting device, and out of an outlet disposed along an outer wall surface of the artificial lifting device into the upper zone of the wellbore.

14. The method of claim 9, wherein step (d) is performed by creating a negative pressure in the upper zone.

15. The method of claim 9, wherein the wellbore comprises casing and the inner wall surface of the wellbore comprises a casing inner wall surface.

16. A method of forming a gravel pack completion in a wellbore bore, the method comprising the steps of:

(a) disposing gravel within a wellbore;

(b) running a downhole tool in a wellbore, the downhole tool comprising a screen, a dynamic isolation device, and an artificial lifting device, the screen being disposed below the dynamic isolation device and the dynamic isolation device being disposed below the artificial lifting device;

(c) contacting the downhole tool with the gravel;

(d) contacting the dynamic isolation device with an inner wall surface of the wellbore thereby dividing the wellbore into an upper zone and a lower zone, the upper zone being disposed above the dynamic isolation device and the lower zone being disposed below the dynamic isolation device;

(e) creating a negative pressure within the upper zone causing a wellbore fluid to be transported from the lower zone and into the upper zone; and lowering the screen into the gravel.

17. The method of claim 16, wherein step (e) comprises pumping fluid down a tubing string in fluid communication with the artificial lifting device.

18. The method of claim 16, wherein step (e) is performed simultaneously with step (f).

19. The method of claim 16, wherein the screen comprises an auger disposed on an outer wall surface of the screen and step (f) comprises rotating the screen and sliding the dynamic isolation device downward along the inner wall surface of the wellbore.

20. The method of claim 16, wherein step (e) comprises flowing fluid from the lower zone of the wellbore, through at least one port in the screen into a screen bore, through a dynamic isolation device bore, into the artificial lifting device, and out of an outlet disposed along an outer wall surface of the artificial lifting device into the upper zone of the wellbore.

* * * * *